US011426002B2

(12) United States Patent
Garrison

(10) Patent No.: US 11,426,002 B2
(45) Date of Patent: Aug. 30, 2022

(54) COMBINATION CHAIR AND BACKPACK ARRANGEMENT

(71) Applicant: Rio Brands LLC, Watertown, CT (US)

(72) Inventor: Scott A. Garrison, Fitchburg, WI (US)

(73) Assignee: ShelterLogic Corp., Watertown, CT (US)

( * ) Notice: Subject to any disclaimer, the term of this patent is extended or adjusted under 35 U.S.C. 154(b) by 173 days.

(21) Appl. No.: 16/733,584

(22) Filed: Jan. 3, 2020

(65) Prior Publication Data

US 2020/0214451 A1 Jul. 9, 2020

Related U.S. Application Data

(60) Provisional application No. 62/790,205, filed on Jan. 9, 2019.

(51) Int. Cl.

| | |
|---|---|
| ***A47C 4/28*** | (2006.01) |
| ***A45F 4/02*** | (2006.01) |
| ***A45C 9/00*** | (2006.01) |

(52) U.S. Cl.

CPC ..... *A47C 4/283* (2013.01); *A45F 4/02* (2013.01); *A45C 9/00* (2013.01); *A45C 2009/002* (2013.01); *A45F 2004/026* (2013.01)

(58) Field of Classification Search

CPC ..... A47C 4/283; A45C 9/00; A45C 2009/002; A45F 4/02; A45F 2004/026

See application file for complete search history.

(56) References Cited

U.S. PATENT DOCUMENTS 4,286,739 A * 9/1981 Silcott ..... A45F 4/02 224/153
4,300,707 A * 11/1981 Kjaer ..... A45F 4/02 224/155
4,392,598 A * 7/1983 Dixon ..... A45F 4/02 224/155
4,487,345 A * 12/1984 Pierce ..... A45F 4/02 224/155

(Continued)

*Primary Examiner* — Brian D Nash
(74) *Attorney, Agent, or Firm* — Carmody Torrance Sandak & Hennessey LLP

(57) ABSTRACT

A combination chair and backpack arrangement. The arrangement includes the folding chair, wherein the folding chair includes a foldable frame, a back support panel, a seat panel, at least one backpack coupler, and at least one harness coupler; the backpack, wherein the backpack comprises at least one pouch, at least one coupler releasably coupleable to the backpack coupler, and at least one harness coupler; and a harness arrangement, wherein the harness arrangement includes a first end coupled to the backpack and a harness coupler selectively coupleable to the at least one harness coupler associated with the backpack and the at least one harness coupler associated with the folding chair; wherein when harness coupler of the harness arrangement is coupled to the at least one harness coupler associated with the backpack, the backpack is carriable independently of the folding chair, and the backpack and the harness arrangement forms a closed loop; and when the harness coupler of the harness arrangement is coupled to the at least one harness coupler associated with the folding chair, the folding chair and the backpack are carriable together.

13 Claims, 9 Drawing Sheets

(56) References Cited

U.S. PATENT DOCUMENTS 4,489,866 A * 12/1984 Korte ..... A45F 4/02 224/155
4,720,029 A * 1/1988 Varanakis ..... A01M 31/02 224/153
5,139,308 A * 8/1992 Ziman ..... A47C 7/622 297/188.06
D338,779 S * 8/1993 Albert ..... D12/416
5,297,708 A * 3/1994 Carpenter ..... A45F 4/02 224/155
5,409,291 A * 4/1995 Lamb ..... A01K 97/10 224/155
5,527,088 A * 6/1996 MacLean ..... A45F 4/02 224/155
5,544,793 A * 8/1996 Harrop ..... A45F 4/02 224/153
5,588,696 A * 12/1996 Jay ..... A47C 1/0265 224/155
5,628,437 A * 5/1997 Kober ..... A01M 31/02 182/187
5,733,000 A * 3/1998 Stump ..... A47C 4/52 297/188.06
5,819,999 A 10/1998 Tennant
6,056,172 A * 5/2000 Welsh ..... A45F 4/02 224/153
6,145,716 A * 11/2000 Caicedo ..... A45F 3/04 224/155
6,739,652 B2 * 5/2004 Welsh ..... A47C 1/0265 297/129
6,764,132 B1 * 7/2004 Gaertner ..... A47C 4/44 297/130
6,843,527 B2 * 1/2005 Nelson ..... A47C 4/40 297/129
6,986,445 B1 * 1/2006 Stockman ..... A45F 4/02 224/155
RE39,022 E 3/2006 Welsh
7,438,355 B2 * 10/2008 Pedemonte ..... A47C 1/143 297/17
7,644,981 B2 * 1/2010 Hensley ..... A47C 4/32 297/17
7,775,587 B1 8/2010 Reed
10,874,216 B2 * 12/2020 Grace ..... A47C 1/16
2004/0189062 A1 * 9/2004 Knight ..... A47C 9/10 297/188.08
2008/0078789 A1 * 4/2008 Fiola ..... A45F 3/08 224/155
2008/0302840 A1 * 12/2008 Missick ..... A45F 4/02 224/155
2009/0084821 A1 * 4/2009 Lenzi ..... A45F 4/02 224/155
2012/0217773 A1 8/2012 Jue
2015/0084381 A1 3/2015 Nelson
2015/0122860 A1 * 5/2015 Berei ..... A45F 3/04 224/576
2015/0366357 A1 * 12/2015 Nelson ..... A47C 7/506 297/35
2018/0338623 A1 * 11/2018 Winterhalter ..... A47C 4/20
2019/0082846 A1 * 3/2019 Grace ..... A47C 4/30
2019/0374033 A1 * 12/2019 Grace ..... A45F 3/14
2020/0214450 A1 * 7/2020 Garrison ..... A47C 3/0252
2021/0045535 A1 * 2/2021 Wilcox ..... B65D 81/3813

* cited by examiner

COMBINATION CHAIR AND BACKPACK ARRANGEMENT

This application claims the benefit of U.S. application Ser. No. 62/790,205 filed on Jan. 9, 2019. The subject matter of said application Ser. No. 62/790,205 is incorporated by reference as if fully set forth herein.

BACKGROUND OF THE INVENTION

The present invention relates to combined chair and backpack arrangements and methods and constructions for assembling, carrying, coupling and decoupling, and the carrying thereof both together and separately, and more particularly, to improved constructions, arrangements and methods to carry out all of the foregoing.

Combined backpack and chairs are known in the art, examples of which may be found in U.S. Pat. No. 4,676,548 and U.S. Patent Reissue No. 39022.

These known backpack/chair combinations come in several variations and yet still have several deficiencies. For example, some prior art constructions provide the folding chair with permanently fixed (e.g. sewn) backpacks connected thereto to allow the user to carry a chair on his/her back and store goods in the storage portion on the chair while walking to his/her intended destination. Deficiencies in the embodiments when the chair and the backpack combination are not detachable include requiring the user to bring the goods to the chair when desirous of filling the storage compartment or requiring the user to bring the entire chair to the location of the goods. Further, when the chair is being used in the seating position there is limited access to the goods in storage because the pouches are usually inconveniently positioned relative to chair when in the sitting/reclining position.

Other attempts have been made to provide for combined chair and backpacks, some of which are also described in U.S. Pat. Nos. 5,409,291; 5,297,708; 7,775,587; and 5,819,999. However, as would be evident to one skilled in the art and despite the convenience of backpack carrying, there are still deficiencies in the construction and versatility of each of the foregoing known prior art constructions.

Therefore, improved constructions for backpack/chair combinations are desirable. For example, it would be desirous of providing a combination chair and backpack arrangement that provides a user the ability to use the backpack in the traditional sense, i.e. as a carrying vessel for beach, camping, or event items without the hassle and added bulk of a chair frame connected to it as is the case with the prior art, or if desired/needed, the user can carry the (e.g., loaded) backpack and chair frame as one unit, allowing for hands-free mobility when walking to the desired location. More importantly, it would be desirous of providing at least the foregoing advantages with a construction that permits easy coupleability and removal of the backpack to/from the chair. It is thus believed that further advances to the state of the art are both desirable and achievable, all of which are provided by the embodiments disclosed herein.

SUMMARY AND OBJECTIVES OF THE INVENTION

It is thus an objective of the present invention to overcome the perceived deficiencies in the prior art.

Specifically, it is an objective of the present invention to provide a combination folding chair and backpack arrangement that provides a user with the mobility to use the backpack in the traditional sense, i.e. as a carrying vessel for beach, camping, or event items while also providing a unique and advantageous coupling system and carrying arrangement that permits easy transport of the backpack and chair frame as one unit, allowing for hands-free mobility when walking to the desired location.

Another objective of the present invention to provide a combination folding chair and backpack arrangement that permits the user, once the user arrives at his/her destination, to deploy the chair and detach the backpack, thus allowing easy access to the contents of the backpack without requiring the user to leave his/her seat.

Yet another objective of the present invention to provide a combination folding chair and backpack arrangement that provides the user with the option of keeping his/her chair in place and utilizing the storage pouch of the backpack for carrying goods to and from the chair's location.

Still another objective of the present invention is to provide a combination folding chair and backpack arrangement that has a construction that provides for shared carrying harness straps that can be routed through and/or around the chair frame to allow the user to position the chair at the most ergonomic location for carrying on one's back, which is a significant improvement over state of the art chair/backpack combinations that provide for the chair carrying straps to be fixed to the chair frame and the chair fabric.

And still another objective of the present invention to provide a combination folding chair and backpack arrangement that provides the still further added benefit of permitting the user to carry multiple chairs, e.g. by providing a construction of the present invention that permits the routing of the harness straps through the one or more chair frames.

Other objectives and advantages of the present invention will become more apparent from a consideration of the drawings and ensuing disclosure.

The invention accordingly comprises the features, combinations of elements and features, arrangement of parts and methods for using the same which will be exemplified in the description and illustrations hereinafter set forth, and the scope of the invention will be indicated in the claims.

Therefore, to overcome the features in the prior art and to achieve the objects and advantages set forth above and below, a first preferred embodiment of the present invention is, generally speaking, directed to a combination chair and backpack arrangement, the arrangement comprising the folding chair, wherein the folding chair comprises a foldable frame, a back support panel, a seat panel, at least one backpack coupler, and at least one harness coupler; the backpack, wherein the backpack comprises at least one pouch, at least one coupler releasably coupleable to the backpack coupler, and at least one harness coupler; and a harness arrangement, wherein the harness arrangement comprises a first end coupled to the backpack and a harness coupler selectively coupleable to the at least one harness coupler associated with the backpack and the at least one harness coupler associated with the folding chair; wherein when harness coupler of the harness arrangement is coupled to the at least one harness coupler associated with the backpack, the backpack is carriable independently of the folding chair; and when the harness coupler of the harness arrangement is coupled to the at least one harness coupler associated with the folding chair, the folding chair and the backpack are carriable together.

In a specific preferred embodiment, the present invention is, generally speaking, directed to a combination folding chair and backpack arrangement, the arrangement comprising the folding chair, wherein the folding chair comprises a frame comprising a U-shaped seat frame coupled to a U-shaped back frame, a U-shaped front leg frame and a U-shaped back leg frame, wherein the U-shaped front leg frame is (i) coupled to the U-shaped seat frame and (ii) coupled to the U-shaped back leg frame, wherein the U-shaped back frame, the U-shaped seat frame, the U-shaped front leg frame, and the U-shaped back leg frame are foldable towards each other; a pair of arm rests pivotally coupled at one end thereof to the U-shaped back frame and adjustably positionable relative to the ends of the U-shaped front leg frame and the U-shaped back leg frame; a back support panel coupled to the U-shaped back frame; a seat panel coupled to the U-shaped seat frame; at least one backpack coupler; at least one harness coupler; the backpack, wherein the backpack comprises at least one pouch; at least one coupler releasably coupleable to the backpack coupler; and at least one harness coupler; and a harness arrangement, wherein the harness arrangement comprises a first end coupled to the backpack; and a harness coupler selectively coupleable to the at least one harness coupler associated with the backpack and the at least one harness coupler associated with the folding chair; wherein when harness coupler of the harness arrangement is coupled to the at least one harness coupler associated with the backpack, the backpack is carriable independently of the folding chair; and when the harness coupler of the harness arrangement is coupled to the at least one harness coupler associated with the folding chair, the folding chair and the backpack are carriable together.

BRIEF DESCRIPTION OF THE DRAWINGS

The above set forth and other features of the present invention are made more apparent in the ensuing Description of the Preferred Embodiments when read in conjunction with the attached Drawings, wherein.

Identical reference numerals in the figures are intended to indicate like parts, although not every feature in every figure may be called out with a reference numeral.

DETAILED DESCRIPTION OF THE PREFERRED EMBODIMENTS

Figure 1:
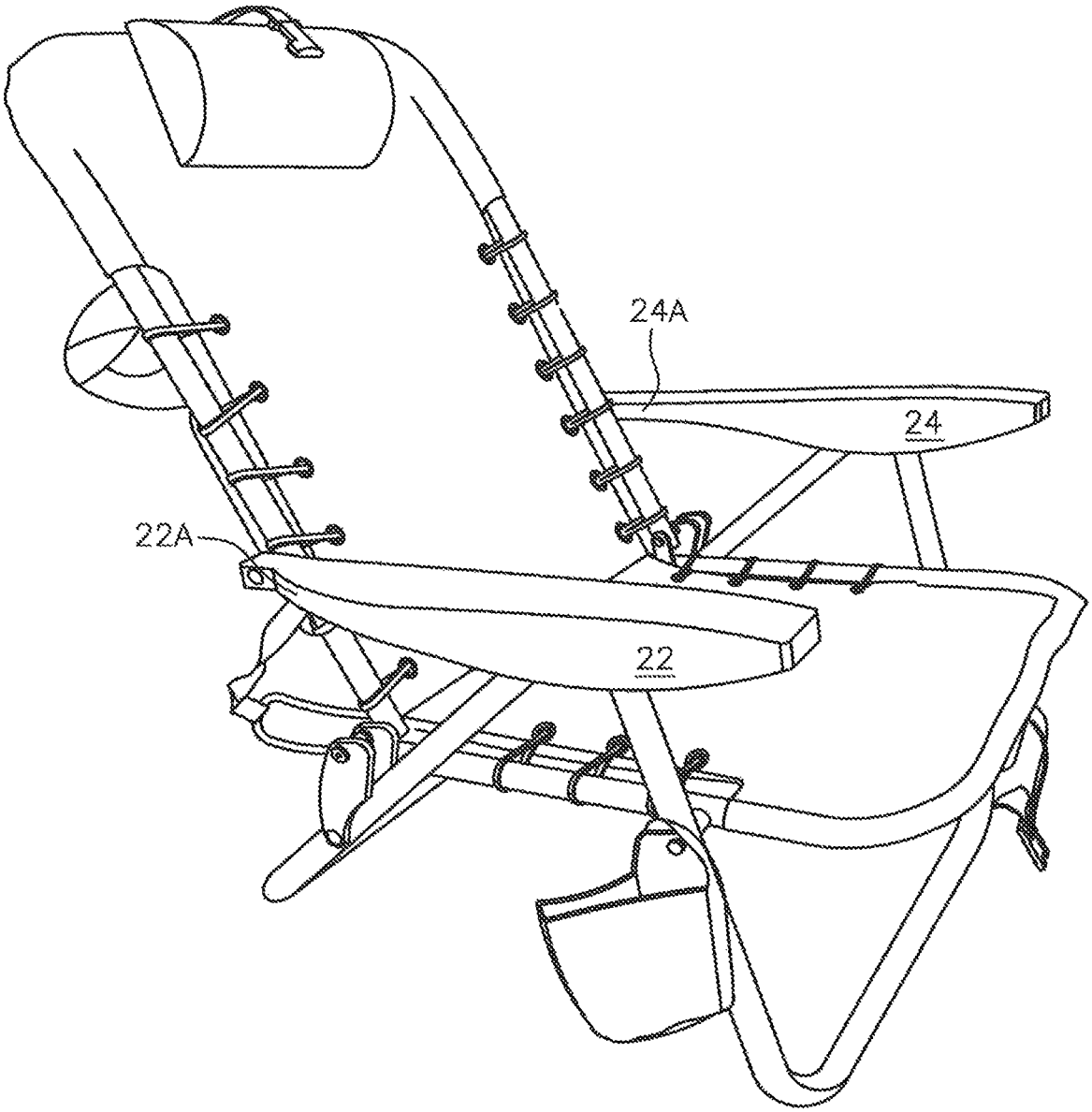
FIG. 1 is a perspective view of a backpack and chair combination constructed in accordance with preferred embodiments of the present invention, showing the chair in an open position.

Reference is first made generally to the construction of a preferred folding chair, generally indicated at 10, constructed in accordance with the present invention. However, and to be sure, the disclosed chair 10 is only one of many folding chair configurations that can be used in connection with the present invention.

In a preferred embodiment, folding chair 10 comprises a frame comprised of metal, metal alloy, plastic and/or combinations of the foregoing, wherein the frame comprises a U-shaped seat frame, generally indicated at 12 rotatably coupled to a U-shaped back frame generally indicated at 14, a U-shaped front leg frame generally indicated at 16 and a U-shaped back leg frame generally indicated at 18. The U-shaped front leg 16 frame is pivotally coupled to the U-shaped seat frame 12 at pivot 20, and the U-shaped front leg 16 is also coupled to the U-shaped back leg frame 18 as will be disclosed below.

Figure 3:
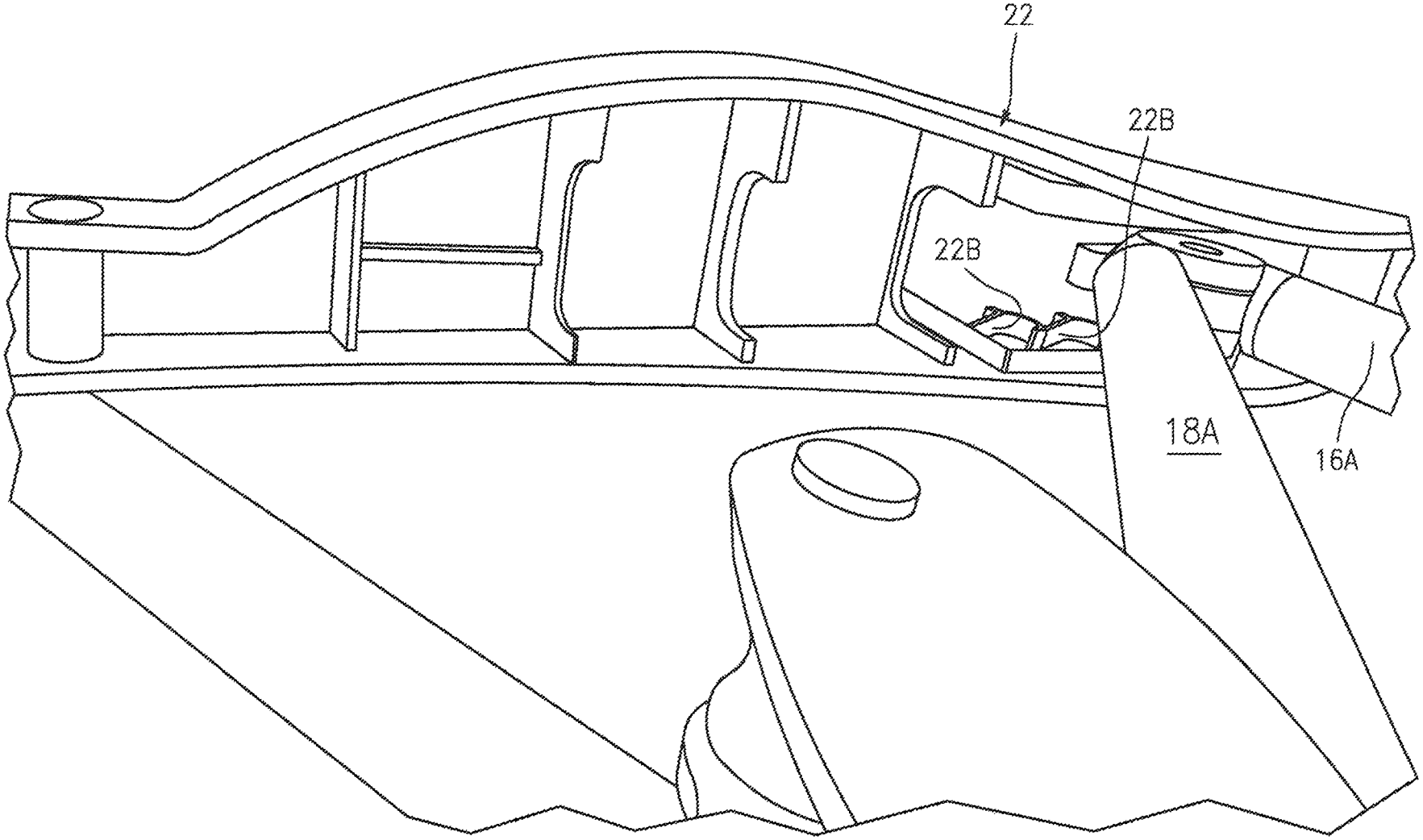
FIG. 3 is a perspective view of the underside of one of the two armrests, the other of which is in mirror image, of a preferred embodiment of the chair constructed in accordance with the present invention.

Folding chair 10 has a pair of arm rests 22, 24 that are pivotally coupled at respective first ends 22A, 24A to the U-shaped back frame 14 at respective pivots 25 on each side, and the arm rests 22, 24 are also adjustably positionable relative to the coupled together ends 16A, 18A of the U-shaped front leg frame 16 and the U-shaped back leg frame 18. As illustrated in FIG. 3 showing the underside of arm rest 22 (arm rest 24 and the respective other ends 16A, 18A the U-shaped front leg frame 16 and the U-shaped back leg frame 18 being made in mirror and/or identical image), ends 16A, 18A of the U-shaped front leg frame 16 and the U-shaped back leg frame 18 are rotatably coupled together, as each end 16A, 18A is coupled to a coupler that itself is provided with shoulders (not shown) that are selectively received in one or more slots 22B provided in the underside of arm rest 22. In this way, the U-shaped seat frame 12 can be positioned in a plurality of reclining and/or upright) positions, as would be understood in the art.

Figure 2:
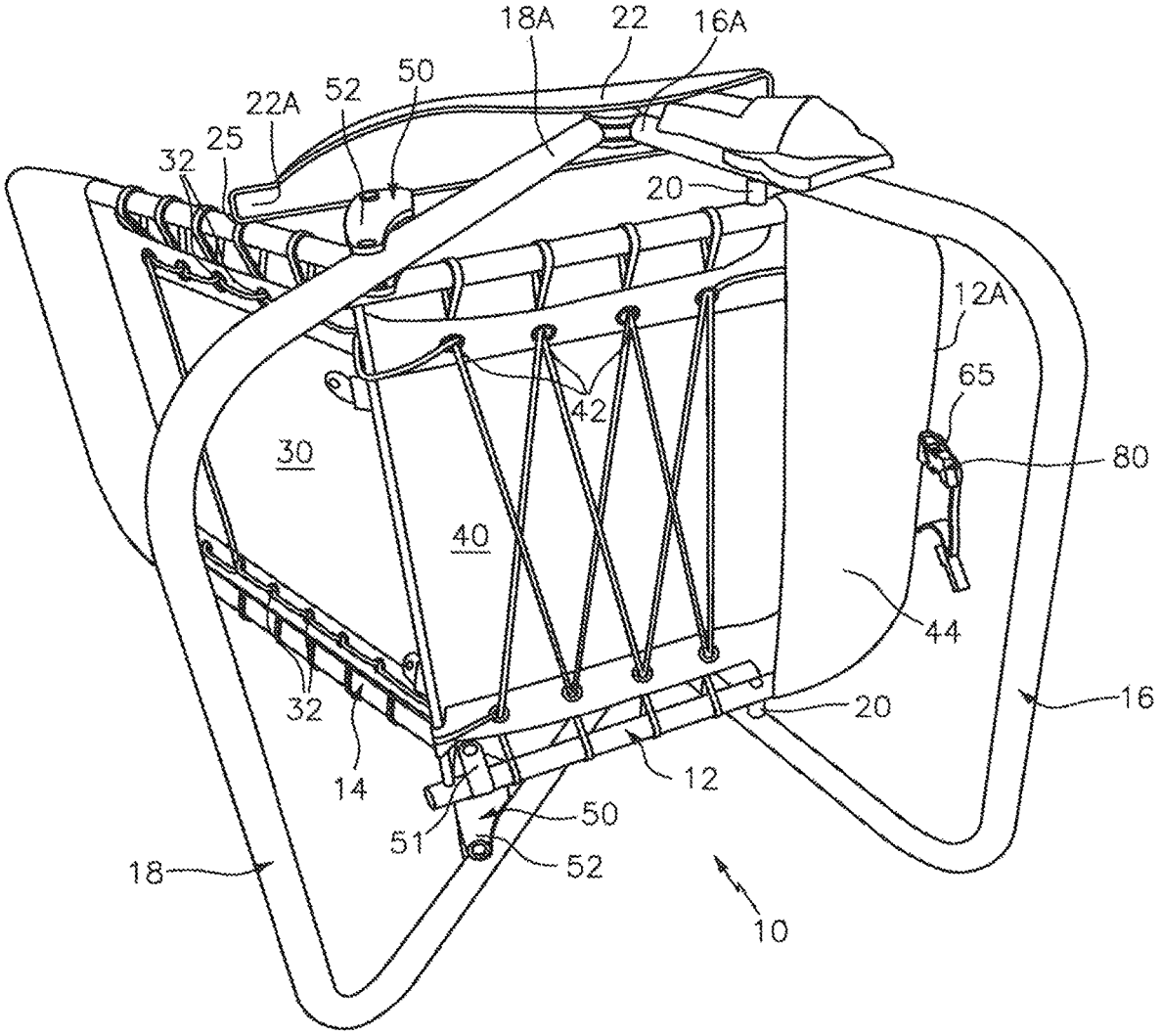
FIG. 2 is a perspective view of the underside of a preferred embodiment of the chair constructed in accordance with preferred embodiments of the present invention.
Figure 4:
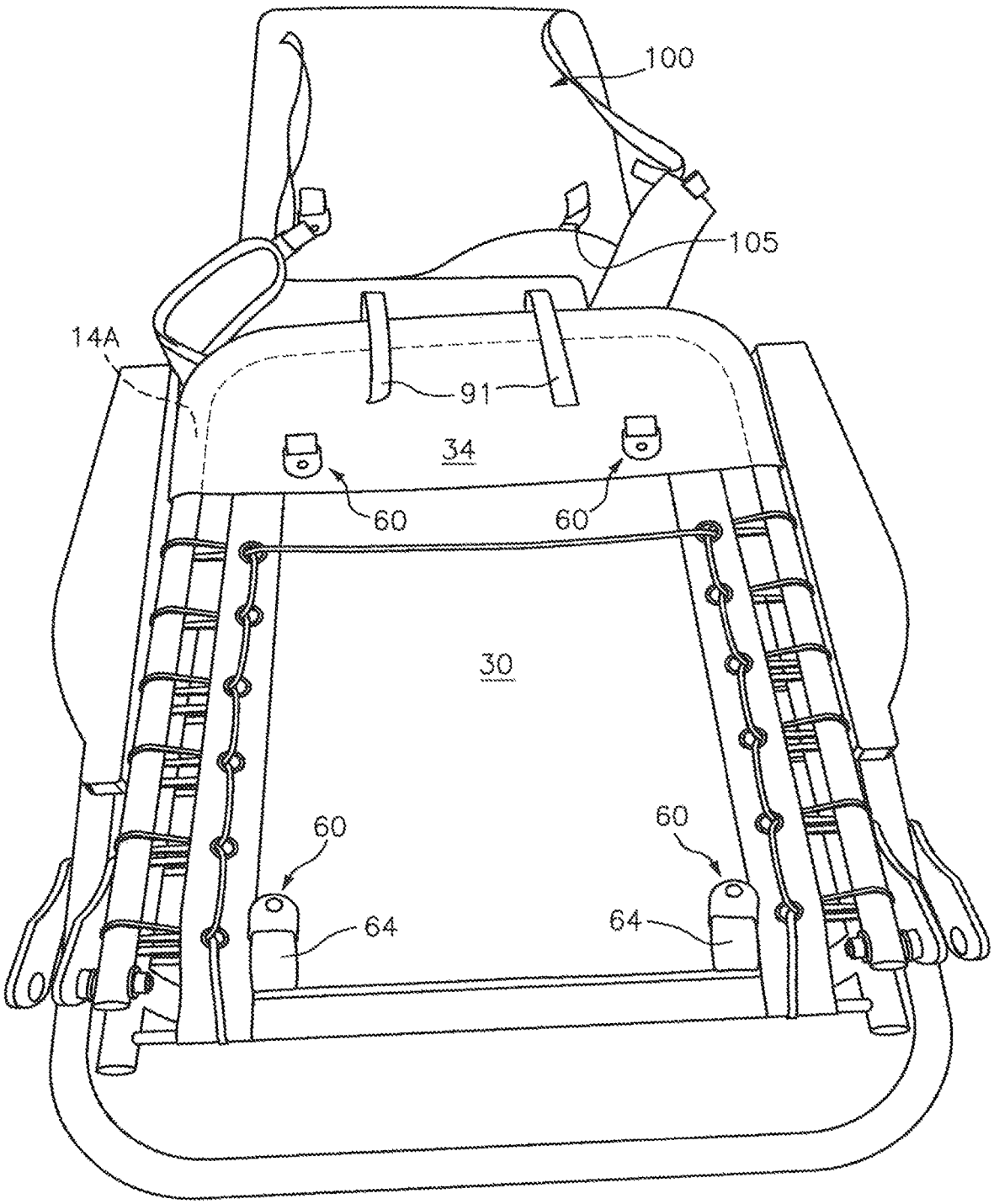
FIG. 4 is a perspective view of the chair of FIGS. 1 and 2 shown in a folded position highlighting a backside of the chair, also showing a backpack constructed in accordance with preferred embodiments of the present invention.

As shown exemplary in FIGS. 2 and 4, folding chair 10 preferably also comprises a back support panel 30 coupled to the U-shaped back frame 14 and a seat panel 40 coupled to the U-shaped seat frame 12. In a preferred embodiment, the back support panel 30 is coupled to the U-shaped back frame 14 by one or more preferably nylon cords that wrap around the U-shaped back frame 14 and along the periphery of the back support panel 30 through a plurality of eyelets 32 (not all of which are numbered) around the periphery of back support panel 30. Similarly, the seat panel 40 is preferably coupled to the U-shaped seat frame 12 by one or more cords that wrap around the U-shaped seat frame 12 and along the periphery of the seat panel 40 through a plurality of eyelets 42 (not all of which are numbered) positioned along the periphery of seat panel 40. All panels herein are preferably, but not necessarily, of a woven or other fabric material.

A top/rear panel generally indicated at 34 may be integral with, stitched or otherwise connected to the top of the back support panel 30 within which is positioned the top section, generally indicated at 14A, of the U-shaped back frame 14. In a similar manner, a bottom/rear panel 44 may be integral with, stitched or otherwise connected to the end of the seat panel 40, within which is positioned the bottom section, generally indicated at 12A, of the U-shaped seat frame 12.

Lastly, a coupling assembly, generally indicated at 50, comprises a connector 51 on each side of the chair 10 to couple an end of the U-shaped back frame 14 to an end of the U-shaped seat frame 12, and together which are pivotally coupled to U-shaped back leg frame 18 by a coupler 52.

Figure 5:
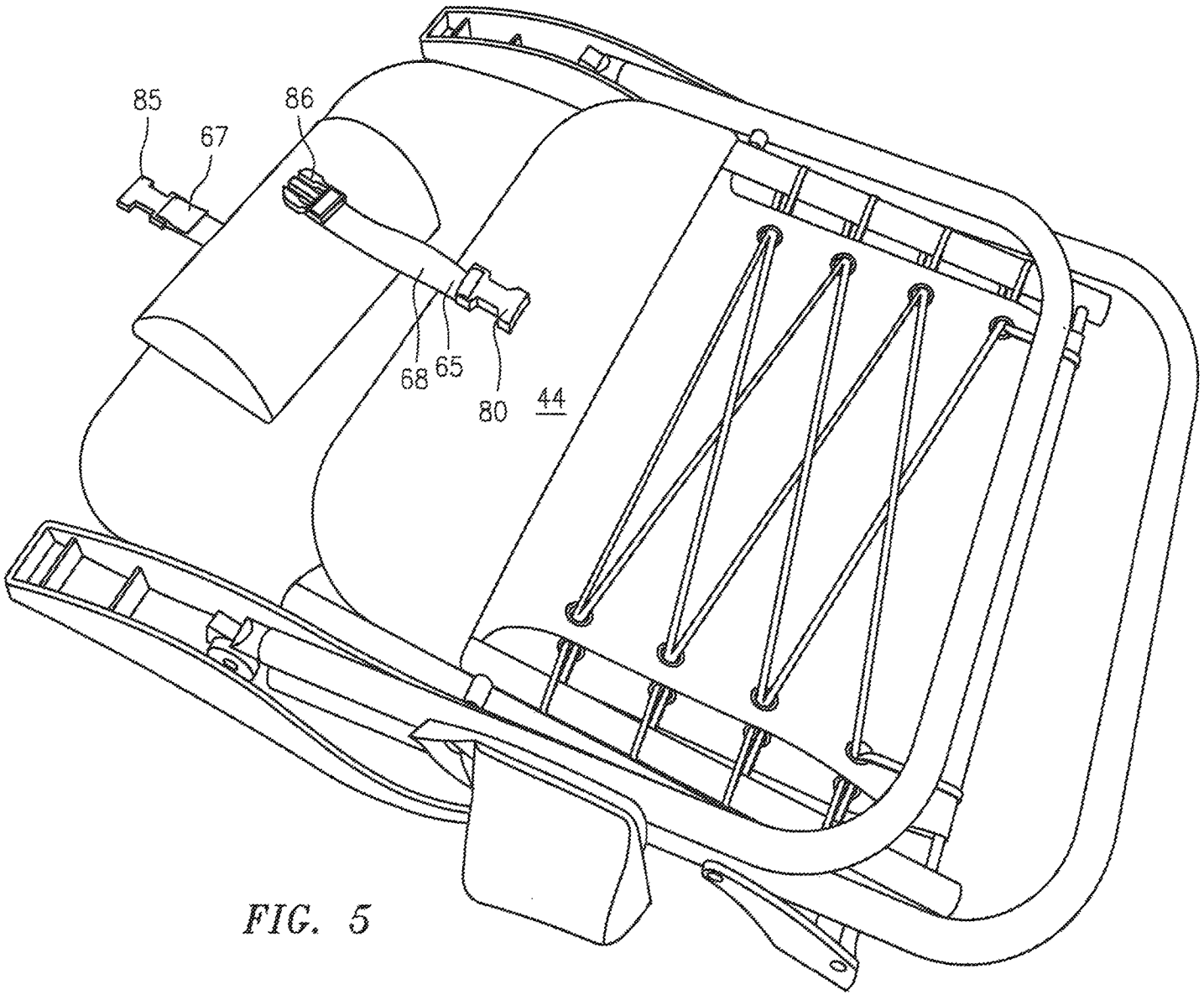
FIG. 5 is a closer view of a portion of the chair of FIGS. 1 and 2 in its folded position.

It should thus be clear that as preferably constructed, the U-shaped back frame 14, the U-shaped seat frame 12, the U-shaped front leg frame 16, and the U-shaped back leg frame 18 are foldable towards each other, as illustrated in FIG. 5.

The foregoing should be understood to be a construction of a preferred folding chair for use in connection with the present invention. However, it should be clearly understood that other folding chairs are equally usable in connection with the present invention, such as for example and not limitation, front-to-back, side-to-side, or quad-fold style folding beach, sporting, and event chairs, whether made of metal, metal alloy, plastic, wood and/or combinations thereof.

In accordance with a preferred embodiment and exemplified in FIG. 4, folding chair 10 also includes at least one backpack coupler, generally indicated at 60. In a preferred embodiment, there are four (4) backpack coupler(s) 60, two (2) of which are coupled to the rear surface of back panel 30 and two of which are coupled to the surface of top/rear panel 34. Of course, other coupling points are contemplated herein. Preferably, each of the backpack couplers 60 are coupled to the material section surfaces by a loop formed by a piece of webbing 64 inserted through a slot in the respective couplers 60, with the webbing itself preferably stitched to the surface of the respective panel surfaces 30, 34. Of course, other means of connecting the webbing 64 to the panel surfaces could be used, including by not limited to adhesive, glue or the like, just to name a few examples. One or more of the webbings may be elastic to facilitate easy couplings of the respective couplers.

Folding chair 10 also comprises at least one harness end coupler 80 (e.g. FIGS. 2, 5). In a preferred embodiment, the at least one harness end coupler 80 is coupled to the surface of bottom/rear panel 44 by a piece of webbing 65 inserted through a slot in harness end coupler 80, with the webbing itself preferably stitched to the surface of bottom/rear panel 44. Again, other coupling points are contemplated herein, and of course, other means of connecting the webbing 65 to the surface of panel 44 could be used, including by not limited to adhesive, glue or the like, just to name a few examples.

The function and purpose of coupler(s) 60 and coupler 80 will be made more apparent below.

Figure 6:
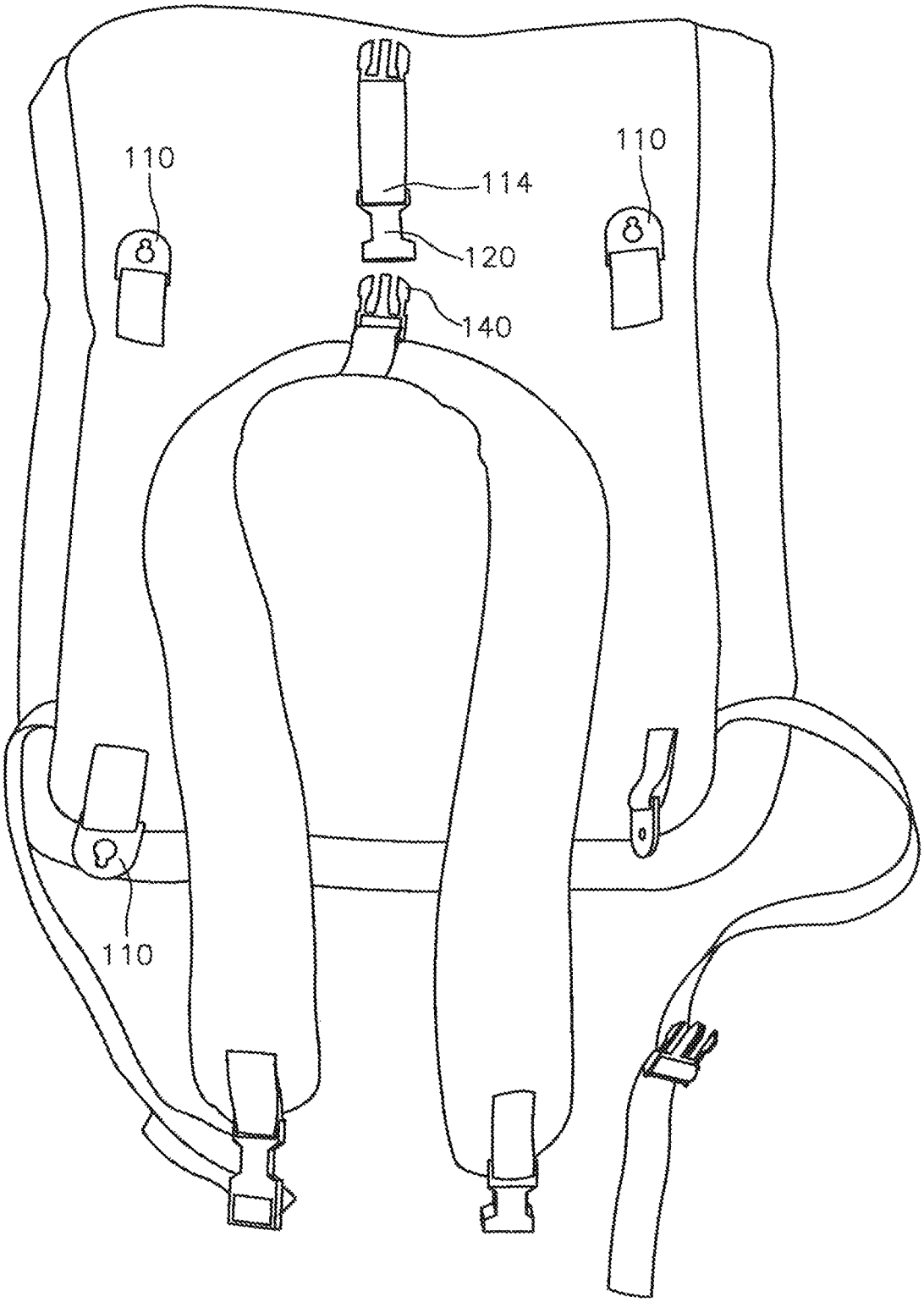
FIGS. 6 and 7 are perspective views of a backpack and a harness arrangement constructed in accordance with preferred embodiments of the present invention.

However, reference is next made to FIG. 6 in connection with the disclosure of a backpack, generally indicated at 100, constructed in accordance with preferred embodiments of the present invention. As illustrated, backpack 100 preferably comprises a pouch 105. Backpack 100 also comprises at least one coupler 110 that releasably engages the at least one backpack coupler 60 associated with the folding chair 10, for releasably coupling the backpack 100 to the folding chair 10. Preferably, the number of backpack couplers 60 and the number of couplers 110 are the same.

In a preferred embodiment, the at least one backpack coupler 60 associated with the folding chair 10 comprises one of a tab 61 or a slotted "keyhole shaped" opening, while the at least one coupler 110 associated with the backpack 100 comprises the other of the tab or "keyhole shaped" slotted opening 115. In this way, the tab 61 is insertable into and removable from the slotted opening 115, preferably in a releasable "snapping" locking arrangement. For the avoidance of doubt, while the embodiment illustrated in the figures provides for the backpack coupler(s) 60 to have the tab(s) 61 and the coupler(s) 110 to have the "keyhole shaped" slotted opening 115 it is contemplated herein that the backpack coupler(s) 60 be provided with the slotted "keyhole shaped" openings 115 while the coupler(s) 110 comprises the tab(s) 61.

As should now be clear, the embodiments herein preferably include (i) a plurality of spaced apart backpack couplers 60 associated with the folding chair, each comprising one of a tab or a slotted opening, and (ii) a plurality of spaced apart couplers 110 associated with the backpack, each of which are respectively coupleable to a corresponding backpack coupler 60 and comprising the other of the tab or slotted opening that is associated with the corresponding backpack coupler.

Backpack 100 also comprises at least one strap end coupler 120, coupled to webbing 114), the function of which will be disclosed below.

Figure 7:
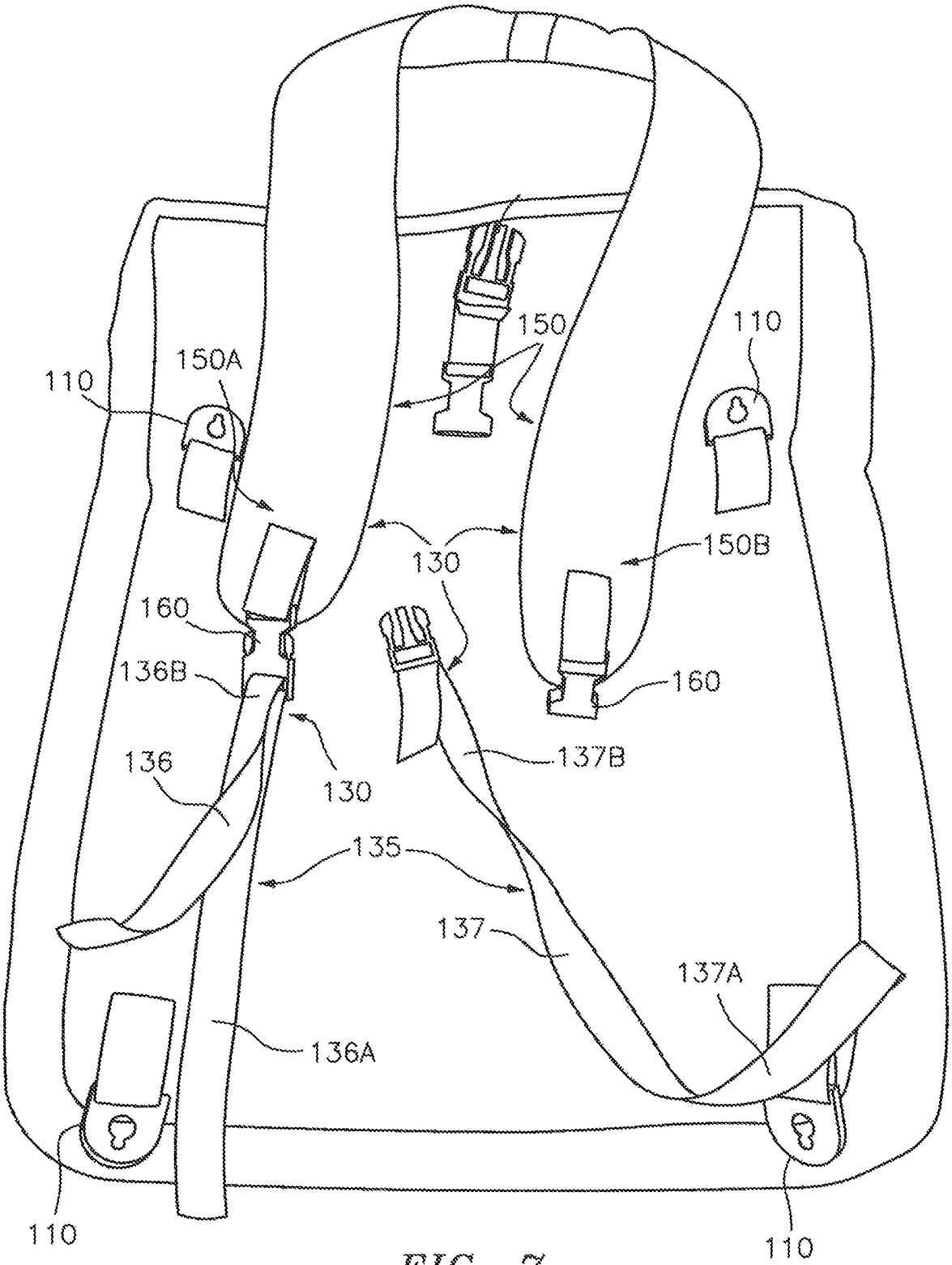

However, first reference is now made to FIG. 7, wherein a harness arrangement, generally indicated at 130, is disclosed in accordance with preferred embodiments of the present invention. Harness arrangement has a first end, generally indicated at 135, coupled to the backpack 100. Harness arrangement 130 also comprises a harness coupler, generally indicated at 140, selectively coupleable to the at least strap end coupler 120 associated with the backpack 100 (as shown in FIG. 6) and the at least one strap end coupler 80 associated with the folding chair 10 (as shown in FIG. 10).

Figure 8:
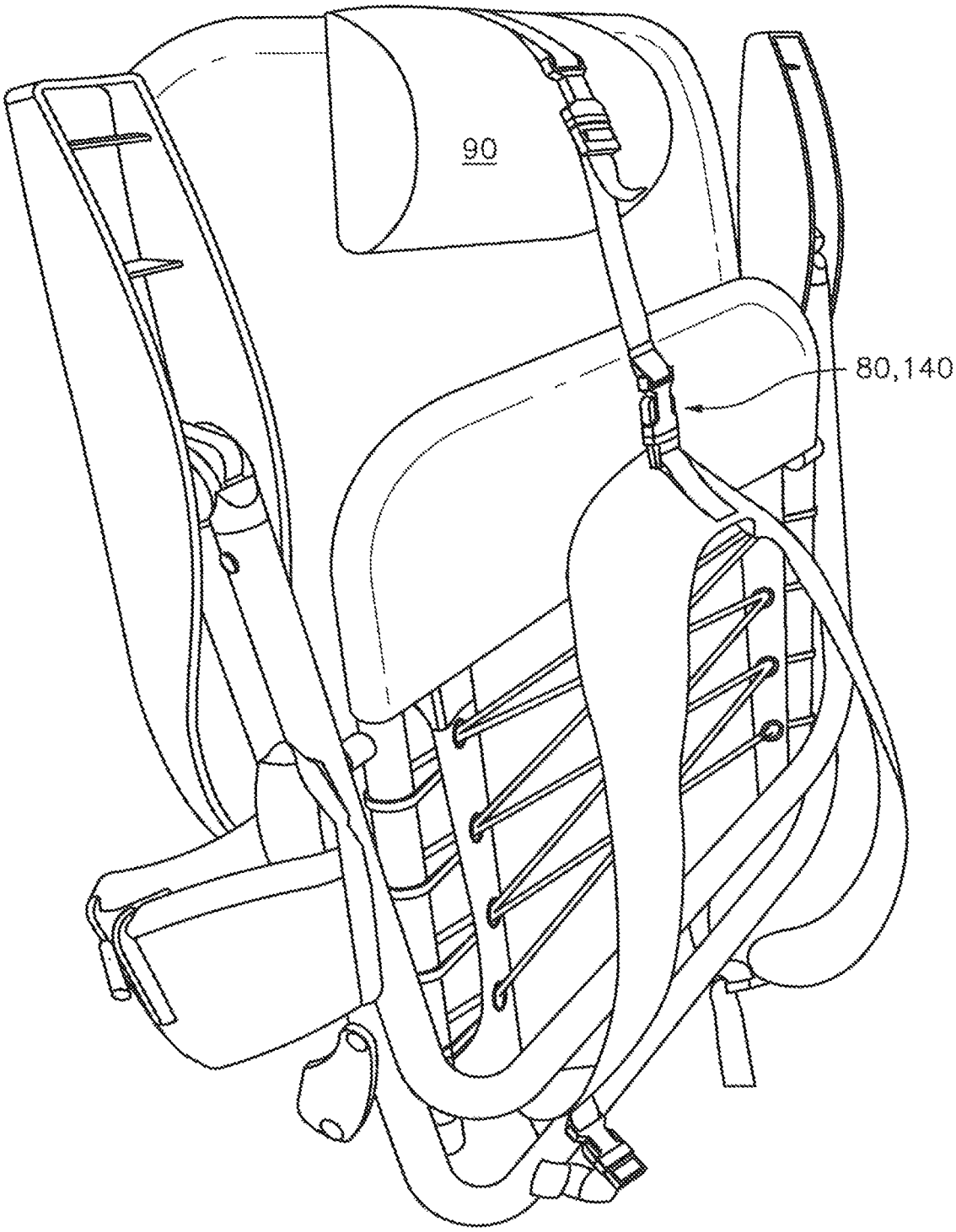
FIG. 8 is a perspective view of the backpack and chair combination constructed in accordance with preferred embodiments of the present invention, showing the chair in a folded and position, with the harness arrangement and backpack coupled to the chair for carrying as a single unit.

In this way, when the harness coupler 140 of the harness arrangement 130 is coupled to the at least one strap end coupler 120 associated with the backpack 100, the backpack is carriable independently of the folding chair 10 (e.g. see FIG. 6), and the backpack and the strap arrangement form a closed loop. Moreover, when the harness coupler 140 of the harness arrangement 130 is coupled to the at least one strap end coupler 80 associated with the folding chair 10, the folding chair and the backpack are carriable together (FIG. 8). As illustrated in the Figures, e.g. FIG. 8 it can be seen that the harness arrangement 130 easily, conveniently and advantageously wraps around the chair to facilitate easy carrying of the chair and backpack combination together.

The harness arrangement 130 comprises a shoulder harness 150. The first end 135 of the harness arrangement 130 that is coupled to the backpack 100 comprises at least a first strap section 136 and a second strap section 137, and wherein (i) the first strap section 136 has a first end 136A and a second end 136B, (ii) the second strap section 137 has a first end 137A and a second end 137B, (iii) the first end 136A of the first strap section 136 is coupled to the backpack 100, (iv) the first end 137A of the second strap section 137 is coupled to the backpack 100, (v) the second end 136B of the first strap section 136 is coupled to a first end 150A of the shoulder harness 150, and (iv) the second end of 137B the second strap section 137 is coupled to a second end 150B of the shoulder harness 150.

In a preferred embodiment, the second end 136B of the first strap section 136 of the harness arrangement 130 is coupleable and lengthwise adjustable to the first end 150A of the shoulder harness 150 by using a mating male/female clip combination, generally indicated at 160 and well known in the art. The clip combination 160 can be provided with a slotted opening to permit the lengthwise adjustability of strap section 136 as also would be well known in the art. In a similar way, the second end 137B of the second strap section 137 of the harness arrangement 130 is coupleable to, and lengthwise adjustable with respect to the second end 150B of the shoulder harness 150 by using a similar mating male/female clip combination, also generally indicated at 160. Likewise, this latter mentioned clip combination 160 can also be provided with a slotted opening to permit adjustability of the length of strap section 137 as also would be well known in the art.

As illustrated e.g. in FIG. 5, to further make the combination folding chair and backpack convenient, safe and secure to carry together as a unit, a length of webbing 67 is preferably stitched to the top edge area of top/rear panel 34 at the other end of which is one of a receiving or inserting coupler end 85. A length of webbing 68 is also preferably stitched to the top edge area of bottom/rear panel 44 at the other end of which is one of a receiving or inserting coupler end 86. Coupling together of the receiving and inserting coupler components 85, 86 in a known manner helps ensure that U-shaped seat frame 12 does not unfold away from U-shaped back frame 14 during carrying of the combination chair 10 and backpack 100 as disclosed herein. A pillow 90 is also provide and preferably removably couplable by way of straps and Velcro connected to head rest support panel 34 of chair 10 as would be known in the art.

As can now be seen by the disclosed embodiments, the present provides significant improvements and advantages over backpack/chair combinations known the in art.

Figure 9A:
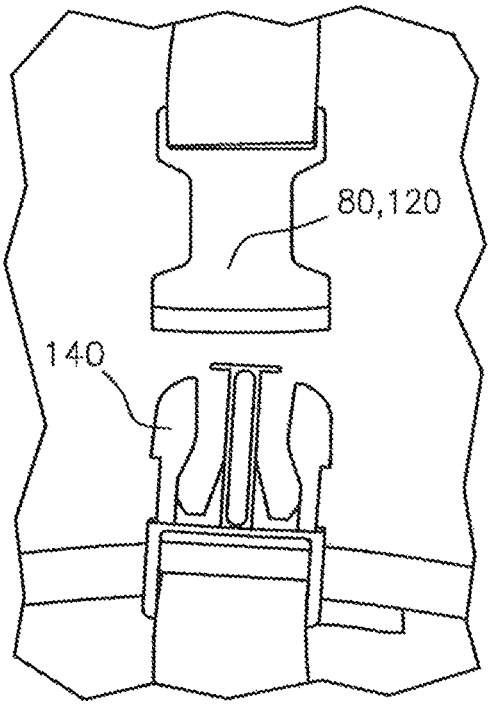
FIGS. 9A, 9B are close up views of preferred, but nevertheless exemplary, couplers in accordance with preferred embodiments of the present invention.
Figure 9B:
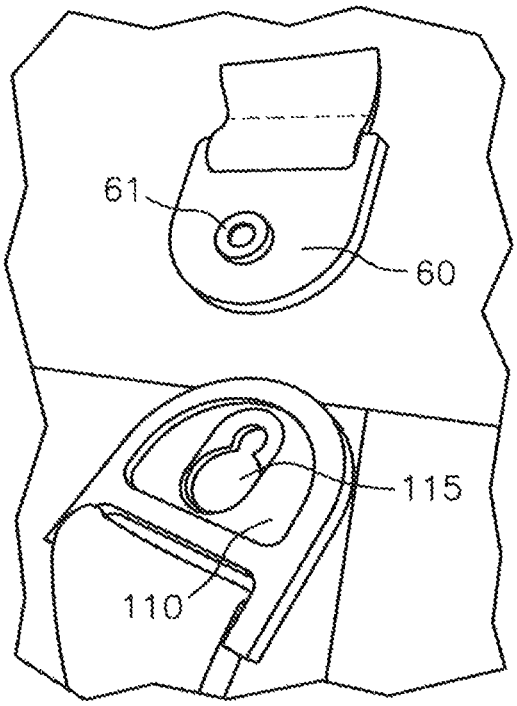

For example, whether the chair used in connection with the present invention is a front-to-back folding chair and/or a quad-fold style chair, the backpack is located either on the chair back or the underside of the chair seat, but can be removed utilizing the coupling arrangements disclosed herein. However, and to be sure, other coupling arrangements can be utilized and are contemplated herein, such as hooks, clips, zippers, and the like, which allow the backpack to be removed from the chair. That is, while the preferred couplers 80, 120, 140 are shown in the figures generally and specifically in FIG. 9A as coupler 140 comprising a center prong and preferably two (2) flexible outer prongs that are insertable and releasably retained in the respective couplers 120, 140 all as known in the art, and while the preferred couplers 60, 110 are also shown in the figures generally and specifically in FIG. 9B, the disclosed and illustrated couplers are by way of example and not limitation, as other couplers, such as those disclosed herein (e.g. hooks, clips, zippers, etc), may be utilized if desired. All other similarly illustrated couplers, e.g. 85, 86 are also as disclosed above.

On a side-to-side folding chair the backpack may be located on either side of the of chair when in its folded position (for example, in connection with a director's chair) and carrying straps are located on the opposing side, but likewise can be removed utilizing the disclosed coupling arrangements and/or a variety of others, such as hooks, clips, zippers, and the like, which allow the backpack to be removed from the chair. In all such chair/backpack combinations of the present invention, removal of the backpack 100 is desirable so that the user can utilize the backpack 100 without the bulk of a chair 10 attached.

In addition, the coupling arrangements and overall disclosed embodiments permit the backpack 100 to both coupled to the chair when being transported but also easily permits interaction with the backpack, (e.g.) the backpack can be disconnected from the chair to be hung on the chair arm 22, 24 or lay on the side of chair, e.g. hanging or propped against, as a handy location while the user is seated in the chair 10, thus providing for easy access to items or other goods in the pouch of the backpack.

Still further, the present invention provides for the harness arrangement 130 to serve double-duty as both the carrying straps for the backpack 100 and the chair 10 when the backpack 100 and chair 10 are carried as a unit (e.g. as shown in FIG. 8). The straps 136, 137 are preferably connected or coupled to the lower portion of the backpack via a permanent or semi-permanent connection (e.g. stitching), while the other ends 136B, 137B of the straps are coupled or connected via a semi-permanent or releasably coupling to the harness 150. Disconnecting the upper portion from the backpack allows the shoulder harness 130 to wrap through or around the frame 12, 14, 16, 18 of the chair 10 and to reconnect to the chair frame, i.e. with the engagement of couplers 80 and 140 (e.g. FIG. 8). This allows the chair 10 and backpack 100 to be carried as one single unit (chair with storage pouch) or used as two separate units (chair and a separate backpack/storage pack). Again, this is to be contrasted with state of the art embodiments that provide for the backpack and carrying straps to be sewn directly to the seat and back material, thus disadvantageously preventing the decoupling of the chair from the backpack.

As should now be appreciated, the benefits of the present invention over the prior art examples are numerous, including but not limited to:

- providing the user with the mobility to use the backpack in the traditional sense, i.e. as a carrying vessel for beach, camping, or event items, i.e. easily transporting only the backpack (filled or unfilled as desired) without the hassle and added bulk of a chair connected to it as is the case with the prior art;
- providing the ability to carry partially/fully loaded backpack and chair as one unit, while allowing for hands-free mobility when walking to the desired location;
- permitting a user, once the user arrives at a destination, to detach the backpack from the chair and deploy the chair 10 (or first deploy the chair 10 and then detaching the backpack 100, all as desired or convenient to the user, thus allowing easy access to the contents of the backpack without requiring the user to leave his or her seat;
- providing the user with the option to maintain the chair in place while utilize the storage pouch of the backpack 100 for carrying goods to and from the location of the chair;
- providing for harness straps to be able to be routed through or around the chair frame to allow the user to position the chair at the most ergonomic location on one's back for carrying, an advantage that is believed to be absent in the prior art chair/backpack combinations that require that the chair carrying straps be generally fixed to the chair frame and the chair fabric; and
- providing the additional benefit of permitting the carrying of multiple chairs type by routing the carrying straps through two chair frames, e.g. routing the carrying straps through the multiple chair frames and then coupling the carrying strap connections from backpack 100 to the coupling points on either of the chair frames, as would be understood from the present disclosure.

Still further, backpack 100 can be of different embodiments. For example, the present invention contemplates backpacks that have a single storage pouch. Alternatively, the backpack can comprise a storage pouch and cooler pouch, or a backpack constructed in accordance with the present invention can be a pannier style bag that allows it to freely stand up when detached from the chair. Still further, preferred embodiments of the backpack may or may not have multiple compartments (storage and cooler sections) in one bag, be comprised of 2 separate bags that can both be detached, be comprised of 2 separate bags and one can be detached, be comprised of a single or multiple bags with hydration system and/or have rigid "legs" sewn into the seams to allow the backpack to stand up freely on the sand.

As thus should now be understood by those skilled in the art, the present invention overcomes all of the aforementioned deficiencies while also providing the advantages mentioned herein as well as those advantages that should be understood by those skilled in the art.

Other advantages and objectives are deemed to be apparent from the disclosure herein. It should also be appreciated that the present invention can be implemented and utilized in numerous ways. While the present invention has been described with respect to preferred embodiments, those skilled in the art will readily appreciate that various changes and/or modifications can be made to the invention without departing from the spirit or scope of the invention.

To be sure, the disclosed coupler(s) 60, 80 as well as all the other couplers herein can be the same, or different as the case may be or of a different design, all as known in the art with respect to conventional couplers as the types disclosed herein.

What is claimed is:

1. A combination folding chair and backpack arrangement, the arrangement comprising:

the folding chair, wherein the folding chair comprises:

a frame comprising a U-shaped seat frame coupled to a U-shaped back frame, a U-shaped front leg frame and a U-shaped back leg frame, wherein the U-shaped front leg frame is (i) coupled to the U-shaped seat frame and (ii) coupled to the U-shaped back leg frame, wherein the U-shaped back frame, the U-shaped seat frame, the U-shaped front leg frame, and the U-shaped back leg frame are foldable towards each other;

a pair of arm rests pivotally coupled at one end thereof to the U-shaped back frame and adjustably positionable relative to the ends of the U-shaped front leg frame and the U-shaped back leg frame;

a back support panel coupled to the U-shaped back frame;

a seat panel coupled to the U-shaped seat frame;

at least one backpack coupler;

at least one harness coupler;

the backpack, wherein the backpack comprises:

at least one pouch;

at least one coupler releasably coupleable to the backpack coupler; and at least one harness coupler; and a harness arrangement, wherein the harness arrangement comprises:

a first end coupled to the backpack; and a harness coupler selectively coupleable to the at least one harness coupler associated with the backpack and the at least one harness coupler associated with the folding chair;

wherein:

when harness coupler of the harness arrangement is coupled to the at least one harness coupler associated with the backpack, the backpack is carriable independently of the folding chair; and when the harness coupler of the harness arrangement is coupled to the at least one harness coupler associated with the folding chair, the folding chair and the backpack are carriable together.

2. The combination folding chair and backpack arrangement as claimed in claim 1, wherein:

the at least one backpack coupler associated with the folding chair comprises one of a tab or a slotted opening; and the at least one coupler associated with the backpack comprises the other of the tab or slotted opening; and wherein the tab is insertable into and removable from the slotted opening.

3. The combination folding chair and backpack arrangement as claimed in claim 2, comprising:

a plurality of spaced apart backpack couplers associated with the folding chair, each comprising one of a tab or a slotted opening; and a plurality of spaced apart couplers associated with the backpack, each of which are respectively coupleable to a corresponding backpack coupler and comprising the other of the tab or slotted opening that is associated with the corresponding backpack coupler.

4. The combination folding chair and backpack arrangement as claimed in claim 3, comprising:

fabric material extending over a portion of the U-shaped back frame, wherein:

at least two (2) of the plurality of backpack couplers associated with the folding chair are coupled to the fabric material extending over the portion of the U-shaped back frame; and a first of the plurality of couplers associated with the backpack is releasably couplable to the at least first backpack coupler associated with the folding chair and a second of the plurality of couplers associated with the backpack is releasably couplable to the at least second backpack coupler associated with the folding chair.

5. The combination folding chair and backpack arrangement as claimed in claim 4, comprising:

at least a third backpack coupler associated with the folding chair and a fourth backpack coupler associated with the folding chair, wherein both the third backpack coupler and the fourth backpack coupler are coupled to the back support panel;

at least a third coupler and a fourth coupler both of which are associated with the backpack, wherein the third coupler associated with the backpack is releasably couplable to the at least third backpack coupler associated with the folding chair and the at least fourth coupler associated with the backpack is releasably couplable to the at least fourth backpack coupler associated with the folding chair.

6. The combination folding chair and backpack arrangement as claimed in claim 1, wherein:

the harness arrangement comprises a shoulder harness;

the first end of the harness arrangement that is coupled to the backpack comprises at least a first strap section and a second strap section, and wherein:

the first strap section has a first end and a second end;

the second strap section has a first end and a second end;

the first end of the first strap section is coupled to the backpack;

the first end of the second strap section is coupled to the backpack;

the second end of the first strap section is coupled to a first end of the shoulder harness; and the second end of the second strap section is coupled to a second end of the shoulder harness.

7. The combination folding chair and backpack arrangement as claimed in claim 6, wherein:

the second end of the first strap section of the strap arrangement is coupleable and lengthwise adjustable to the first end of the shoulder harness; and the second end of the second strap section of the harness arrangement is coupleable and lengthwise adjustable to the second end of the shoulder harness.

8. A combination chair and backpack arrangement, the arrangement comprising:

the folding chair, wherein the folding chair comprises a foldable frame, a back support panel, a seat panel, at least one backpack coupler, and at least one harness coupler;

the backpack, wherein the backpack comprises at least one pouch, at least one coupler releasably coupleable to the backpack coupler, and at least one harness coupler; and a harness arrangement, wherein the harness arrangement comprises a first end coupled to the backpack and a harness coupler selectively coupleable to the at least one harness coupler associated with the backpack and the at least one harness coupler associated with the folding chair;

wherein when the harness coupler of the harness arrangement is coupled to the at least one harness coupler associated with the backpack, the backpack is carriable independently of the folding chair; and when the harness coupler of the harness arrangement is coupled to the at least one harness coupler associated with the folding chair, the folding chair and the backpack are carriable together.

9. The combination folding chair and backpack arrangement as claimed in claim 8, wherein:

the at least one backpack coupler associated with the folding chair comprises one of a tab or a slotted opening; and the at least one coupler associated with the backpack comprises the other of the tab or slotted opening; and wherein the tab is insertable into and removable from the slotted opening;

whereby when the tab of the of the at least one backpack coupler associated with the folding chair or the at least one coupler associated with the backpack is inserted into the slotted opening of the other of the at least one backpack coupler associated with the folding chair or the at least one coupler associated with the backpack, the backpack is coupled to the folding chair.

10. The combination folding chair and backpack arrangement as claimed in claim 9, comprising:

a plurality of spaced apart backpack couplers associated with the folding chair, each comprising one of a tab or a slotted opening; and a plurality of spaced apart couplers associated with the backpack, each of which are respectively coupleable to a corresponding backpack coupler and comprising the other of the tab or slotted opening that is associated with the corresponding backpack coupler.

11. The combination folding chair and backpack arrangement as claimed in claim 8, wherein:

the harness arrangement comprises a shoulder harness;

the first end of the harness arrangement that is coupled to the backpack comprises at least a first strap section and a second strap section, and wherein:

the first strap section has a first end and a second end;

the second strap section has a first end and a second end;

the first end of the first strap section is coupled to the backpack;

the first end of the second strap section is coupled to the backpack;

the second end of the first strap section is coupled to a first end of the shoulder harness; and the second end of the second strap section is coupled to a second end of the shoulder harness.

12. The combination folding chair and backpack arrangement as claimed in claim 11, wherein:

the second end of the first strap section of the strap arrangement is coupleable and lengthwise adjustable to the first end of the shoulder harness; and the second end of the second strap section of the harness arrangement is coupleable and lengthwise adjustable to the second end of the shoulder harness.

13. The combination folding chair and backpack arrangement as claimed in claim 8, wherein the frame is comprised of a U-shaped seat frame coupled to a U-shaped back frame, a U-shaped front leg frame and a U-shaped back leg frame, wherein the U-shaped front leg frame is (i) coupled to the U-shaped seat frame and (ii) coupled to the U-shaped back leg frame, wherein the U-shaped back frame, the U-shaped seat frame, the U-shaped front leg frame, and the U-shaped back leg frame are foldable towards each other.

* * * * *